US006830144B2

(12) United States Patent
Dörner

(10) Patent No.: US 6,830,144 B2
(45) Date of Patent: Dec. 14, 2004

(54) DEVICE FOR TRANSPORTING AWAY WORK PIECES PROCESSED IN A PRESS

(75) Inventor: Reiner Dörner, Eppingen (DE)

(73) Assignee: Schuler Automation GmbH & Co. KG, Hessdorf (DE)

( * ) Notice: Subject to any disclaimer, the term of this patent is extended or adjusted under 35 U.S.C. 154(b) by 0 days.

(21) Appl. No.: 10/392,976

(22) Filed: Mar. 21, 2003

(65) Prior Publication Data

US 2003/0177917 A1 Sep. 25, 2003

(30) Foreign Application Priority Data

Mar. 22, 2002 (DE) ..... 102 12 951

(51) Int. Cl.[7] ..... B65G 47/26
(52) U.S. Cl. ..... 198/436
(58) Field of Search ..... 198/436

(56) References Cited

U.S. PATENT DOCUMENTS 1,878,156 A * 9/1932 Lorenz ..... 198/436
2,259,728 A * 10/1941 Bridges ..... 118/425
3,373,664 A * 3/1968 Friedrich ..... 493/218
4,527,936 A * 7/1985 Hartlieb ..... 414/790.4
4,941,793 A * 7/1990 Shiraishi et al. ..... 198/458
5,201,626 A * 4/1993 Hansen ..... 414/398
5,363,685 A * 11/1994 Luthi et al. ..... 72/405.13
5,483,876 A * 1/1996 Davis et al. ..... 100/207
6,520,317 B2 * 2/2003 Sherwin ..... 198/438

* cited by examiner

*Primary Examiner*—Joe Dillon, Jr.
(74) *Attorney, Agent, or Firm*—Browdy and Neimark, P.L.L.C.

(57) ABSTRACT

A device for transporting away work pieces (5) processed in a press (1) from an output station (4) that is disposed downstream from the press (1) in a work piece flow direction onto a conveyor device (6) that conveys the work pieces (5) away, incorporates a removal device (2) that removes the work pieces (5) from the press (1) and moves them into the output station (4), which has a transfer device (7) disposed downstream from it for the alternating transfer of the work pieces (5) from the output station (4) into one of two discharge stations (10, 11) that are disposed to both sides of the output station (4). Each discharge station (10, 11) has an assigned relocation device (8, 9) to relocate the work pieces (5) from the given discharge station (10, 11) onto the conveyor device (6). The conveyor device (6) is formed by two conveyors (12, 13) that are assigned to one of the two relocation devices (8, 9) in each case.

14 Claims, 4 Drawing Sheets

DEVICE FOR TRANSPORTING AWAY WORK PIECES PROCESSED IN A PRESS

Figure 1:
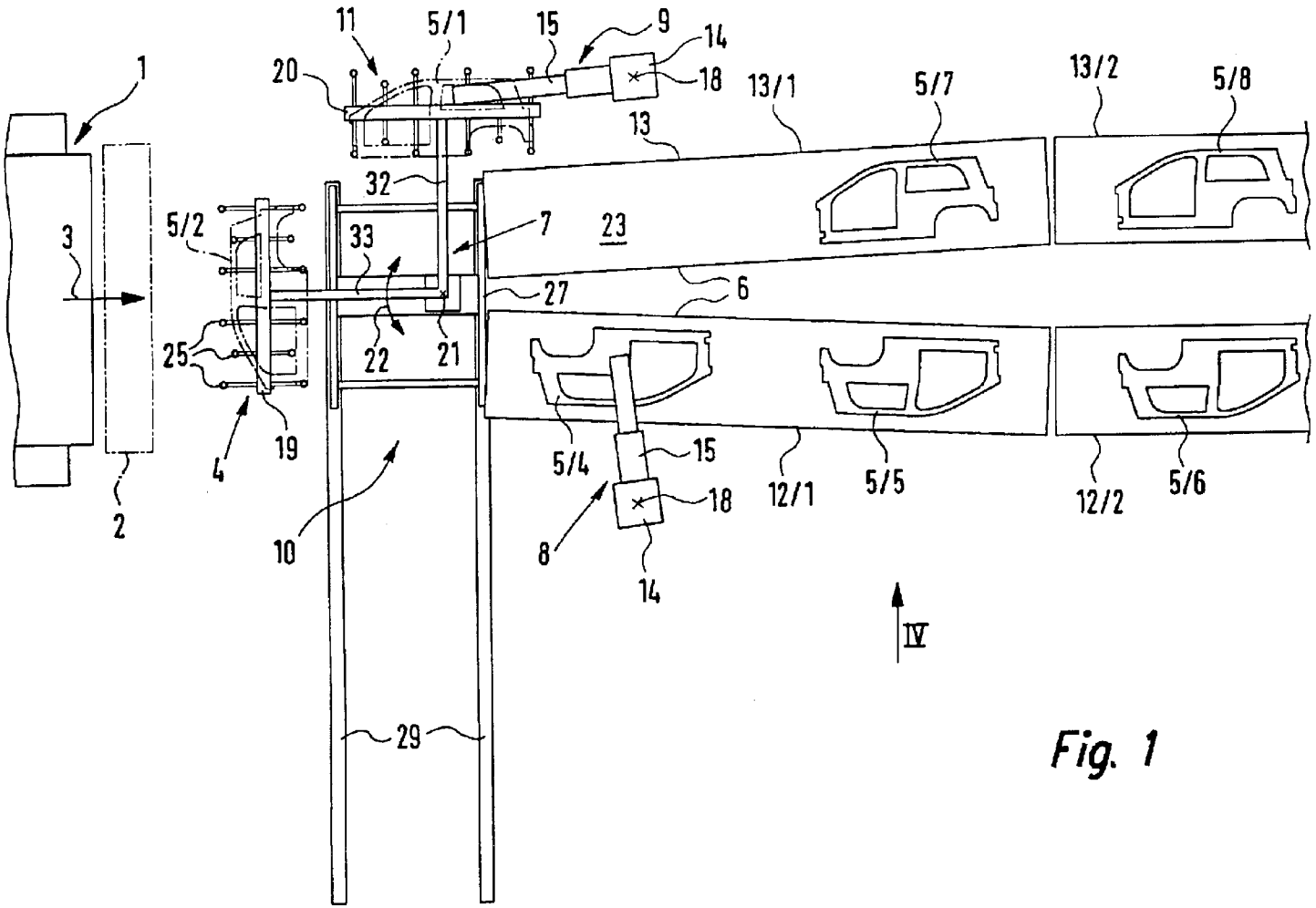

The present invention is concerned with a device for transporting away work pieces processed in a press from an output station that is disposed downstream from the press in a work piece flow direction onto a conveyor-belt-like conveyor device that conveys the work pieces away, incorporating a removal device that takes the work pieces out of the press and moves them to the output station.

Customarily, work pieces that are processed in a press—which may also be a press working line consisting of multiple presses—in particular sheet metal pieces, for example in the form of auto body components, are deposited by the removal device in the output station that is disposed on the output side of the press or last press, respectively, from where they are moved, one after another, directly onto the conveyor device. The conveyor device transports the work pieces to one or multiple consecutive removal locations, for example, where the work pieces are taken off the conveyor device by workers and stacked, for example.

It is the object of the invention to attain the highest possible output of work pieces.

This object is met according to the invention in such a way that a transfer device that is disposed downstream from the removal device exists for an alternating transfer of the work pieces from the output station into one of two discharge stations disposed on each side of the output station, that each discharge station has an assigned relocation device to relocate the work pieces from the given discharge station onto the conveyor device, and that the conveyor device is formed by two conveyors, each of which is assigned to one of the two relocation devices.

In the conventional systems, the conveyor device, which is composed of a single conveyor, is operated in the same cycle as the given press. The cycle speed cannot be randomly increased as the removal of the work pieces from the conveyor by the workers would otherwise be rendered more difficult or impossible. In the inventive device, in contrast, the press may operate at double the cycle speed of the conveyors since the work pieces are distributed onto the two conveyors, so that the output of work pieces can be doubled while maintaining the same speed as before. It goes without saying that, to remove the work pieces from the two conveyors, workers are standing at each of the conveyors.

The transfer device transports the work pieces in an alternating sequence to the two discharge stations, from where they are picked up by means of the given relocation device. Because of the interposed transfer device the relocation devices cannot collide with the removal device. The press and the relocation devices, which operate in the same cycle as the conveyors, may therefore be operated at different speeds.

The transfer device is advantageously movable back and forth between two end positions and incorporates two work piece pick-up devices that are disposed offset from one other in such a way that in one end position the first one of the pick-up devices is positioned in the output station and the second pick-up device is positioned in the first discharge station, and in the other end position the second pick-up device is positioned in the output station and the first pick-up device is positioned in the second discharge station. The transfer device is advantageously swiveled back and forth between its two end positions in the process. The swivel angle may be 90°. This has the added advantage that the work pieces are received by the relocation devices and placed onto the conveyors in a position that is rotated by 90° from the position in which they leave the press. This position on the conveyors after a 90° rotation corresponds to a common requirement in the industry.

Additional advantageous designs of the invention will be specified in the subclaims.

Figure 2:
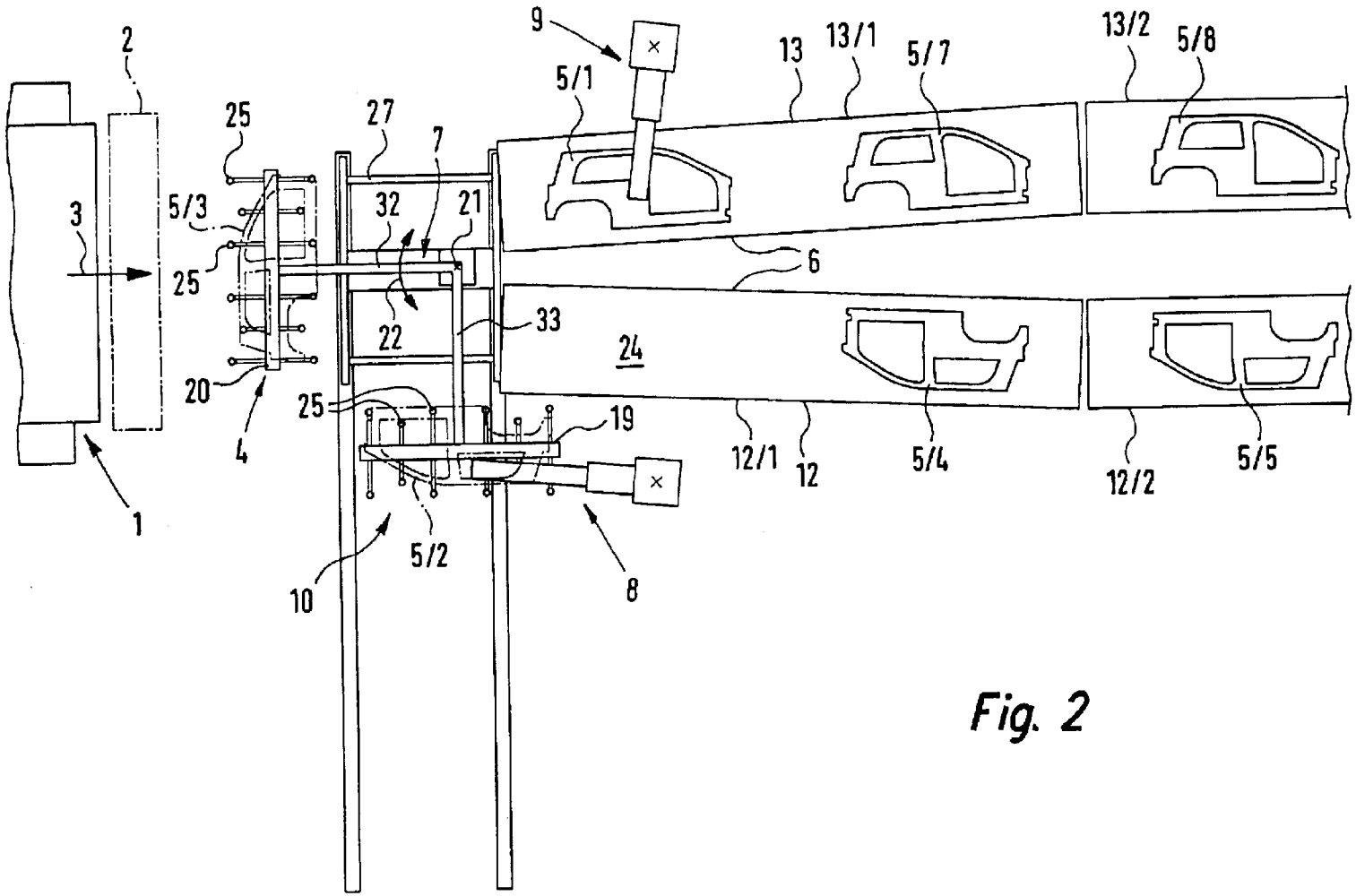
Figure 3:
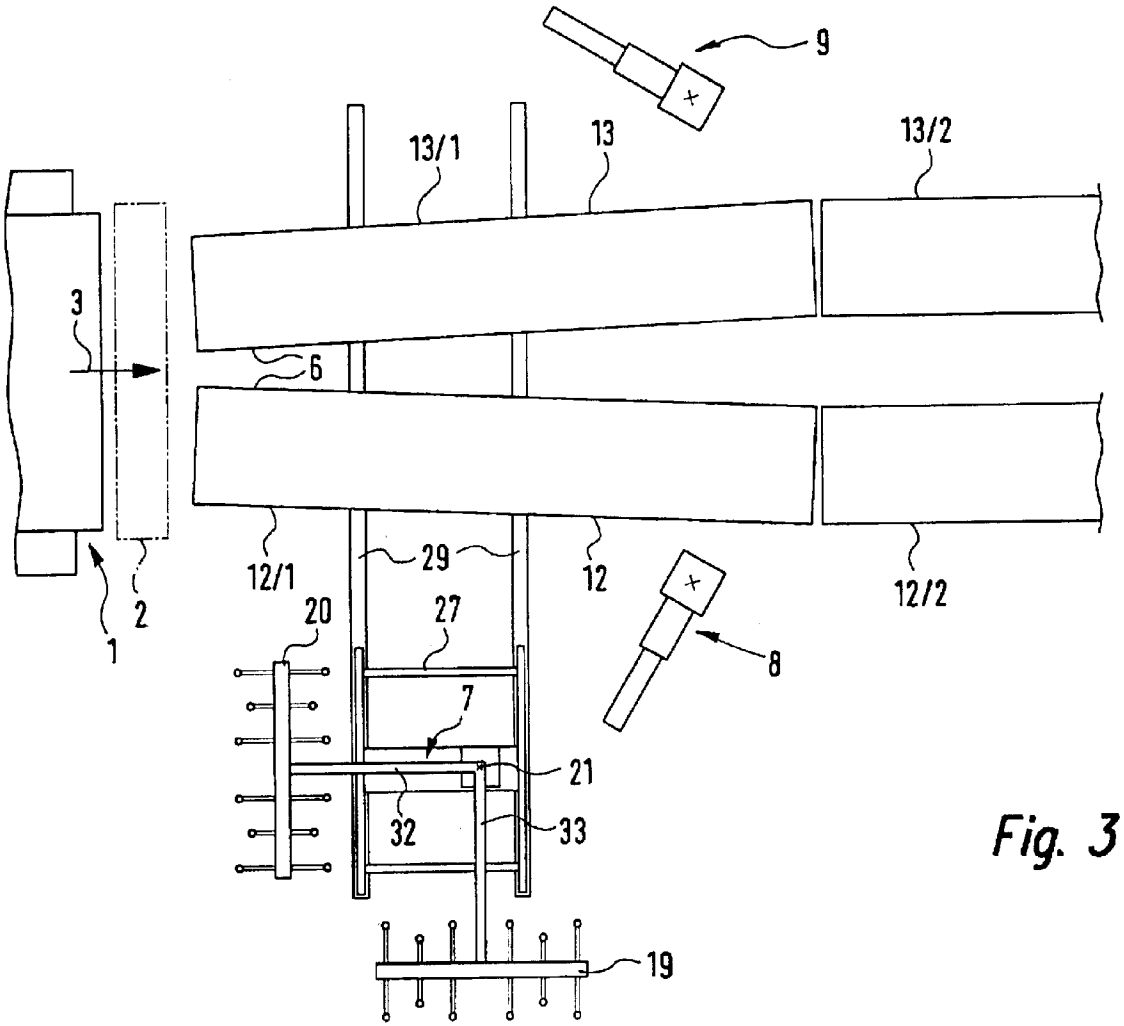
Figure 4:
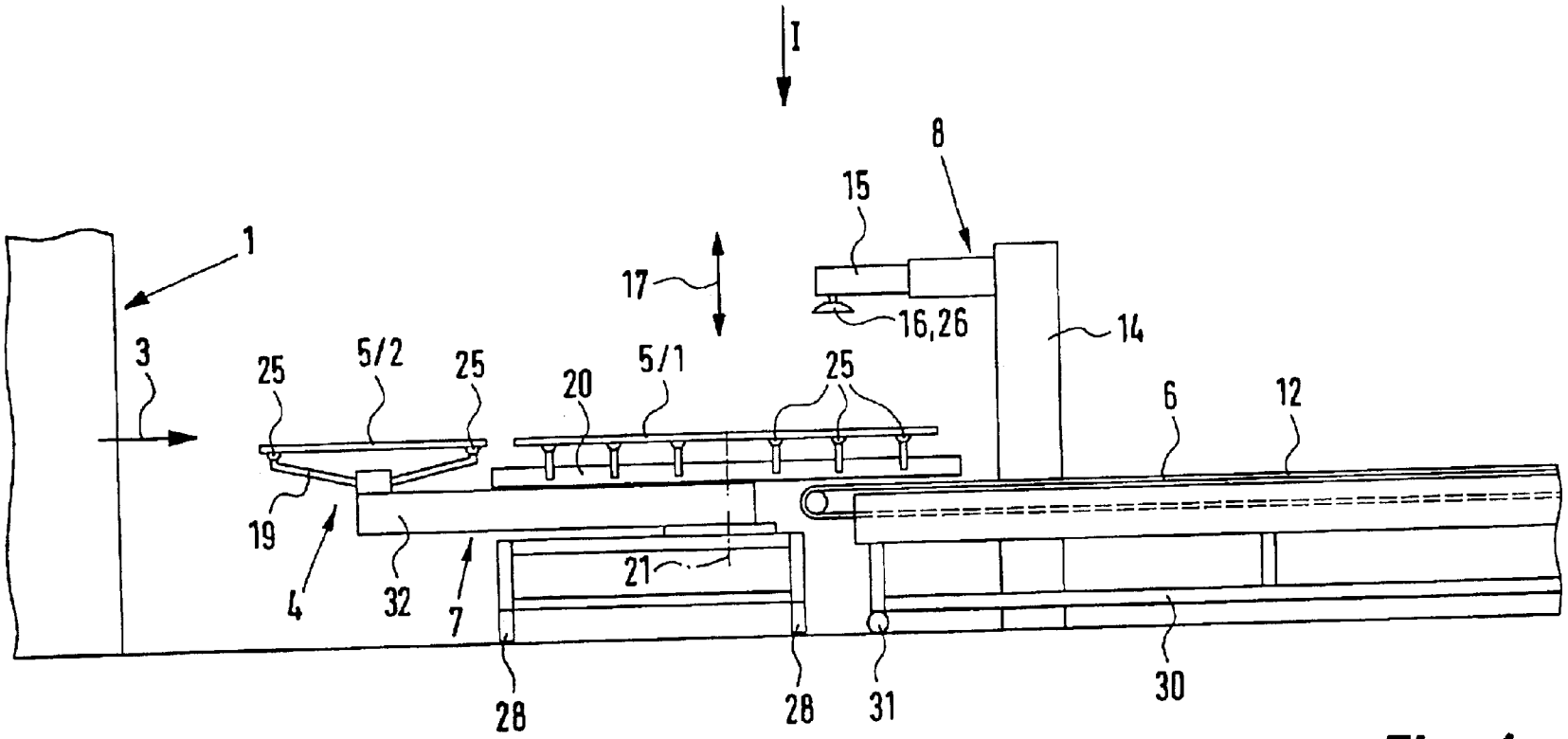

An embodiment of the invention will be described below with the aid of the drawing, in which:

FIG. 1 shows an inventive device in a very schematized top view corresponding to arrow I in FIG. 4 with the transfer device positioned in its one end position, wherein the work pieces that are held by the two pick-up devices of the transfer device are drawn only in a dot-and-dash pattern merely for ease of viewing, as the pick-up devices would otherwise be largely obstructed from view (the removal device, which is known per se, is also marked only in a dot-and-dash pattern), FIG. 2 shows the same device as in FIG. 1, however, with the transfer device assuming its other end position, FIG. 3 again shows the same device in the top view, however, with the transfer device moved into an idle position and the conveyor device moved past the transfer device towards the press, and FIG. 4 shows the system of FIG. 1 in a side view according to the arrow IV in FIG. 1

In a press 1, which may be a single press or the last press in a press working line, consecutive work pieces 5 are processed that are subsequently taken out of the press 1 by a removal device 2 of customary design (shown only in a rough outline by a dot-and-dash pattern) which operates in the cycle speed of the press 1, and transferred into an output station 4 that is positioned downstream from the press 1 in a work piece flow direction 3. The work pieces 5 are sheet metal pieces that are being shaped, for example, into auto body components, as can be seen from the drawing.

The work pieces are marked, in addition to the reference numeral 5, also with an additional numeral added after a slash that serves to individualize the work pieces.

The work pieces 5 are then moved from the output station 4 onto a conveyor-belt-like conveyor device 6 that transports the work pieces 5 in a direction away from the press 1. This takes place by means of a transfer device 7 that is disposed downstream from the removal device 2 between the removal device 2 and the conveyor device 6, and two relocation devices 8, 9, which are disposed crosswise to the shown longitudinal direction of the conveyor device 6 corresponding to the work piece flow direction 3, to both sides of the conveyor device 6.

The transfer device 7 transfers the work pieces 5 from the output station 4 in alternating sequence to the first and second of two discharge stations 10, 11 that are disposed on both sides of the output station 4, to each of which one of the relocation devices 8, 9 is assigned that relocate the work pieces 5 from the discharge stations 10, 11 onto the conveyor device 6.

The conveyor device 6 is formed by two conveyors 12, 13 extending horizontally, side by side, which are driven and controlled separately. The two conveyors 12, 13 may each be formed by a plurality of single conveyors 12/1, 12/2, or 13/1, 13/2, respectively, in the longitudinal direction of the conveyors or at slight angles. The two conveyors 12, 13 each are assigned to one of the two relocation devices 8, 9.

The relocation devices 8, 9 are positioned at a distance to the output station 4 so that they cannot reach the same and thus cannot reach into the region of the removal device 2. The relocation devices 8, 9 are additionally each formed by a robot-like manipulating device that incorporates the degrees of freedom of movement required to relocate the work pieces from the given discharge station 10 or 11 onto the assigned conveyor 12 or 13. The drives that are assigned to these degrees of freedom of movement are controlled by means of a suitable control unit, which may be programmable. Manipulating devices of this type are generally known so that a detailed description is not necessary. In the presented case they have a vertical, erect column element 14 and a robot arm 15 laterally projecting from the same that has a work piece holder 16 disposed on it to hold the work pieces 5. Due to the degrees of freedom of movement that are integrated into the relocation devices 8, 9, the work piece holders 16 can be moved in the vertical direction 17 and in a radial direction relative to the given column element 14, as well as around a swivel axis 18 extending in the vertical direction. In the presented embodiment, the relocation devices 8, 9 are swivelable in their entirety around the swivel axis 18 in each case.

The transfer device 7 can be moved back and forth between two end positions indicated in FIGS. 1 and 2 and incorporates a first work piece pick-up device 19 and a second work piece pick-up device 20, which are disposed offset from one another. In the shown embodiment, the transfer device 7 is swivelable between its end positions around a vertical swivel axis 21 in the direction according to the arrow 22. The swivel angle between the two end positions is advantageously essentially 90°. As a result, as will become more apparent from the description below, the angle position of the work pieces 5 is rotated by essentially 90°, so that the work pieces, which maintain their rotated position during the subsequent transport by means of the relocation devices 8, 9, are placed onto the conveyors 12, 13 in a position that is rotated by 90° from their position in the output station 4.

The movement of the transfer device 7 is motor-driven and controlled in such a way that it takes place in the same cycle as that of the press 1, and both the forward movement as well as the opposite return movement of the transfer device 7 corresponds to one press cycle.

In one end position (FIG. 1), the first work piece pick-up device 19 of the transfer device 7 is positioned in the output station 4 and the second pick-up device 20 is positioned in the first discharge station 11 that is assigned to the conveyor 13 and first relocation device 9. In the other end position (FIG. 2), the second pick-up device 20 is positioned in the output station 4 and the first pick-up device 19 is positioned in the second discharge station 10.

The drives of the different systems are controlled such that said systems perform coordinated movements during their operation, resulting in the following sequence of movements:

FIG. 1 shows the situation after the second work piece pick-up device 20 of the transfer device 7, which, prior to this, has picked up in the output station the work piece 5/1, which, for ease of viewing has been marked only in a dot-and-dash pattern but does exist in reality, has been swiveled into one end position. This work piece 5/1 is picked up by means of the first relocation device 9 from the first discharge station 11 and placed onto the free space 23 on the conveyor 13, which, prior to this, was advanced by a necessary distance and which is standing still during the process. The two work pieces 5/7 and 5/8 were placed onto the conveyor 13 during preceding cycles.

Simultaneously with this process, the next work piece 5/2, which is also drawn only in a dot-and-dash pattern, is picked up in the output station 4 by the first pick-up device 19.

The transfer device 7 is then swiveled with an empty second work piece pick-up device 20 into its opposite end position (FIG. 2) so that the work piece 5/2 is positioned in the second discharge station 10 and, by means of the second relocation device 8, can be moved onto the free space 24 on the conveyor 12, which was previously advanced by an appropriate distance and which is standing still during the process. The other work pieces 5/4, 5/5 and 5/6 were placed onto the conveyor 12 earlier.

Simultaneously with the relocation of the work piece 5/2 from the discharge station 10 onto the conveyor 12, the second pick-up device 20 of the transfer device 7 picks up the next work piece 5/3.

The transfer device 7 is subsequently swiveled back into the end position shown in FIG. 1, so that the described sequence can start anew.

It is apparent that the two conveyors 12, 13 move forward in cycles. The movements of the two conveyors 12, 13 are offset in phase to one another, i.e., the standstill phases of one conveyor occur between the movement phases of the respective other conveyor.

It is apparent that the transfer device 7 operates both transfer devices 8, 9 and, hence, also both conveyors, in an alternating sequence.

The work pieces 5 may be removed from the conveyors 12, 13 by workers standing to both sides of the conveyor device 6.

The two pick-up devices 19, 20 of the transfer device 7 each form a support for the work pieces 5. In the output station 4, the work pieces can therefore be placed by the removal device 2 directly onto the given pick-up device 19, 20. The arrangement is furthermore designed such that the relocation devices 8, 9 contact the work pieces 5 from above, so that these can be directly removed in the discharge stations 10, 11 by the pick-up devices 19, 20.

The two pick-up devices 19, 20 and the two relocation devices 8, 9, may be provided with work piece holders in the form of suction holders 25, 26, as indicated in the drawing, to hold the work pieces 5.

There are numerous options for the specific implementation of the transfer device 7. One advantageous possibility consists of the transfer device 7 having two support arms 32, 33 that extend in an essentially radial direction relative to the swivel axis 21 and are disposed at an angle to one another (90° in the presented embodiment), on the free end sections of which one of the pick-up devices 19, 20 is disposed in each case.

In case that the described sequence of movements is not required, the inventive device has an integrated option for a direct transfer of the work pieces by the removal device 2 to the conveyor device 6.

For this purpose the transfer device 7 may be moved from its operating position (FIGS. 1 and 2) located between the press 1 and conveyor device 6 into an idle position, which is shown in FIG. 3. This movement takes place crosswise to the longitudinal direction of the conveyor device 6, so that the space between the press 1 and conveyor device 6 is freed up. The conveyor device 6 is additionally disposed movable in its longitudinal direction, so that it can be moved, after the transfer device 7 has been moved into its idle position, past the transfer device 7 toward the press 1 (FIG. 3). The work pieces may then be placed directly onto the conveyor device 6. If two work pieces are processed simultaneously in the press 1 side by side, they can be distributed onto the two conveyors 12, 13.

The transfer device 7 is carried on a cart 27 with rollers 28 that run on rails 29 extending crosswise to the longitudinal direction of the conveyor device so that the cart 27 and, hence, the transfer device, can be moved between its operating position and its idle position.

The conveyor device 6 is disposed on a stand 30 with rollers 31, which is movable in the longitudinal direction of the conveyor device 6, said rollers 31 being disposed on rails extending in the longitudinal direction, so that the conveyor device 6 can be moved back and forth in the longitudinal direction.

What is claimed is:

1. A device for transporting away work pieces processed in a press from an output station that is disposed downstream from the press in a work piece flow direction onto a conveyor device that conveys the work pieces away, wherein a transfer device having two arms, each having a plurality of support surfaces (7) exists for the alternating transfer of the work pieces (5) from the output station (4) into one of two discharge stations (10, 11) that are disposed to both sides of the output station, that each discharge station (10, 11) has an assigned relocation device (8, 9) to relocate the work pieces (5) from the given discharge station (10, 11) onto the conveyor device (6), and that the conveyor device (6) is formed by two conveyors (12, 13) that are assigned to one of the two relocation devices (8, 9) in each case.

2. A device according to claim 1, characterized in that the transfer device (7) is movable back and forth between two end positions and incorporates two work piece pick-up devices (19, 20) that are disposed offset from one another, in such a way that in one end position the first of the pick-up devices (19, 20) is positioned in the output station (4) and the second pick-up device is positioned in the first discharge station (11), and in the other end position the second pick-up device is positioned in the output station (4) and the first pick-up device is positioned in the second discharge station (10).

3. A device according to claim 2, characterized in that the transfer device (7) can be swiveled back and forth between its two end positions around a swivel axis (21) that is positioned vertically in the operating position.

4. A device according to claim 3, characterized in that the transfer device (7) is swivelable by essentially 90° between its two end positions.

5. A device according to any of claims 1 through 4, characterized in that the transfer device (7) or its pick-up devices (19, 20), respectively, and/or the relocation devices (8, 9) are provided with suction holders (25, 26) to hold the work pieces surfaces of said suction holders (5).

6. A device according claim 3, characterized in that the transfer device (7) incorporates two carrying arms (32, 33) that extend in an essentially radial direction relative to the swivel axis (21), on the free end sections of which one of the pick-up devices (19, 20) is disposed in each case.

7. A device according to claim 2 characterized in that the two pick-up devices (19, 20) each form a support for the work pieces (5) so that the work pieces (5) are placed in the output station (4) onto the given pick-up device (19, 20).

8. A device according to claim 7, characterized in that the transfer devices (8, 9) contact the work pieces (5) from above.

9. A device according to claim 1, characterized in that the relocation devices (8, 9) are disposed crosswise to the longitudinal direction of the conveyor device (6) next to the same.

10. A device according to claim 1, characterized in that the transfer device (7) is movable from its operating position between the press (1) and conveyor device (6) into an idle position, and the conveyor device (6), when the transfer device (7) is located in its idle position, can be moved past the same toward the press (1) so that the work pieces (5) can be placed directly onto the conveyor device (6).

11. A device according claim 4, characterized in that the transfer device (7) incorporates two carrying arms (32, 33) that extend in an essentially radial direction relative to the swivel axis (21), on the free end sections of which one of the pick-up devices (19, 20) is disposed in each case.

12. A device according claim 5, characterized in that the transfer device (7) incorporates two carrying arms (32, 33) that extend in an essentially radial direction relative to the swivel axis (21), on the free end sections of which one of the pick-up devices (19, 20) is disposed in each case.

13. A device according to claim 11 characterized in that the two pick-up devices (19, 20) each form a support for the work pieces (5) so that the work pieces (5) are placed in the output station (4) onto the given pick-up device (19, 20).

14. A device according to claim 13, characterized in that the transfer devices (8, 9) contact the work pieces (5) from above.

* * * * *